United States Patent [19]

Warwick

[11] Patent Number: 4,681,354

[45] Date of Patent: Jul. 21, 1987

[54] WINDOW GRILL LATCH

[76] Inventor: David R. Warwick, 51 Silverwood Dr., Lafayette, Calif. 94549

[21] Appl. No.: 935,529

[22] Filed: Nov. 25, 1986

[51] Int. Cl.[4] ..... E05C 1/12

[52] U.S. Cl. ..... 292/37

[58] Field of Search ..... 292/37, 38, 302, 170, 292/32, 40, 41

[56] References Cited

U.S. PATENT DOCUMENTS

| | | | |
|---|---|---|---|
| 974,564 | 11/1910 | Frank | 109/17 |
| 1,169,113 | 1/1916 | Barringer | 292/37 |
| 1,510,206 | 9/1924 | Bond | 109/17 |
| 2,409,007 | 10/1946 | Young | 109/18 |
| 2,711,565 | 6/1955 | Levin | 20/71 |
| 2,905,493 | 9/1959 | Tocchetto | 292/37 |
| 4,019,281 | 4/1977 | Weiler | 49/56 |
| 4,034,685 | 7/1977 | Word | 109/17 |
| 4,055,360 | 10/1977 | Russi | 292/228 |
| 4,070,048 | 1/1978 | Young | 292/179 |
| 4,127,966 | 12/1978 | Schmidt | 49/141 |
| 4,263,747 | 4/1981 | Coltrin | 49/56 |
| 4,616,863 | 10/1986 | Bryant | 292/302 |

FOREIGN PATENT DOCUMENTS

| | | | |
|---|---|---|---|
| 615116 | 10/1926 | France | 292/37 |

*Primary Examiner*—Richard E. Moore

*Attorney, Agent, or Firm*—Robert R. Tipton

[57] ABSTRACT

A latch for a window grill utilizes an upper latch member and a lower latch member spring biased together and each having side panels adapted to engage a wedge or cam member for moving the upper and lower latch members toward and away from each other. The upper and lower latch members, as well as the wedge and cam members, are adapted to slidably engage the walls of a generally rectangular housing, which housing acts as a guide to the moving parts.

5 Claims, 7 Drawing Figures

WINDOW GRILL LATCH

BACKGROUND OF THE PRIOR ART

This invention relates generally to latching devices and in particularly to latching and quick release devices for window grills.

Latching and quick release devices for windows in general, are numerous and varied.

For window grills, where the operating handle is located within the building and the grill latch is located outside the building, cable operated window latch releases are generally used because they can be conveniently adapted to pass through the building wall without the need for precision location.

In one prior art device, a telescoping tube spans the joint between two abutting tubes or bars of the grill frame. A cable is used to pull the telescoping tube away from the joint releasing the two abutting tubes or bars thus opening the grill frame.

In another quick release device, a push rod is used to release a plug-like latch mechanism to free the end of a grill support bar and allow the grill to swing open.

A more complex release device utilizes a capsule containing a compressed gas. Operation of the cable actuated device punctures the seal on the capsule releasing the pressurized gas, which gas pressure is used to overcome the retaining force of the latch and release the grill.

Another quick release latch utilizes a frusto-conical member disposed between two roller bars to cause a pair of latching members to separate and release the grill bar.

All of the prior art devices were somewhat complicated and expensive to manufacture.

SUMMARY OF THE INVENTION

The grill latch of the present invention utilizes an upper latch member and a lower latch member which are moved toward and away from each other to engage and release a grill bar or bolt using a wedge or cam actuator of a particular shape operated by a pull cable. The latch members utilize a generally rectangular housing as a guide.

It is, therefore, an object of the present invention to provide a quick release device for a window grill or the like.

It is another object of the present invention to provide a quick release device for a window grill in which a cam-like or lever-like device is used to actuate the release mechanism.

It is yet another object of the present invention to provide a quick release device for window grill in which the latch members can automatically adjust to inaccuracies of placement of the receiving latch bolt.

These and other objects of the present invention will become manifest upon study of the following detailed description when taken together with the drawings.

DESCRIPTION OF THE PREFERRED EMBODIMENT

Figure 1:
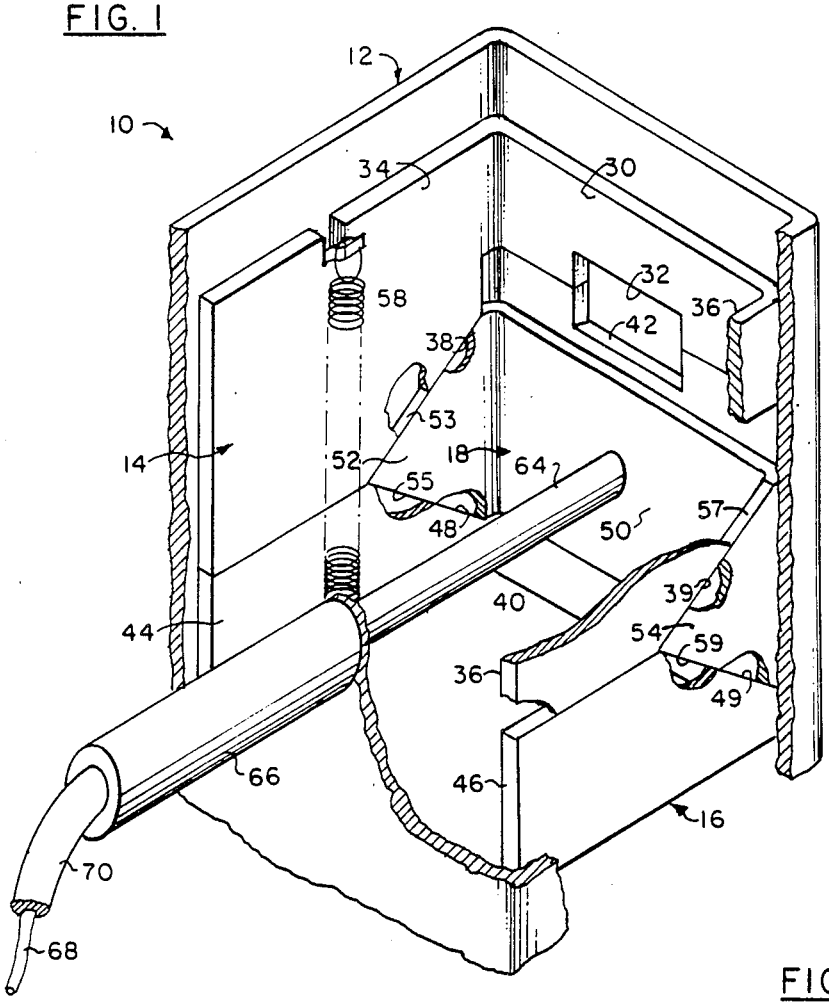
FIG. 1 is an isometric, partial cutaway view of the window grill latch device of the present invention.

With reference to FIG. 1, there is illustrated a partial cutaway, isometric view of the grill latch device 10 of the present invention comprising, essentially, a housing 12, in which are slidably disposed an upper latch member 14, a lower latch member 16 and a latch actuating member 18.

Figure 2:
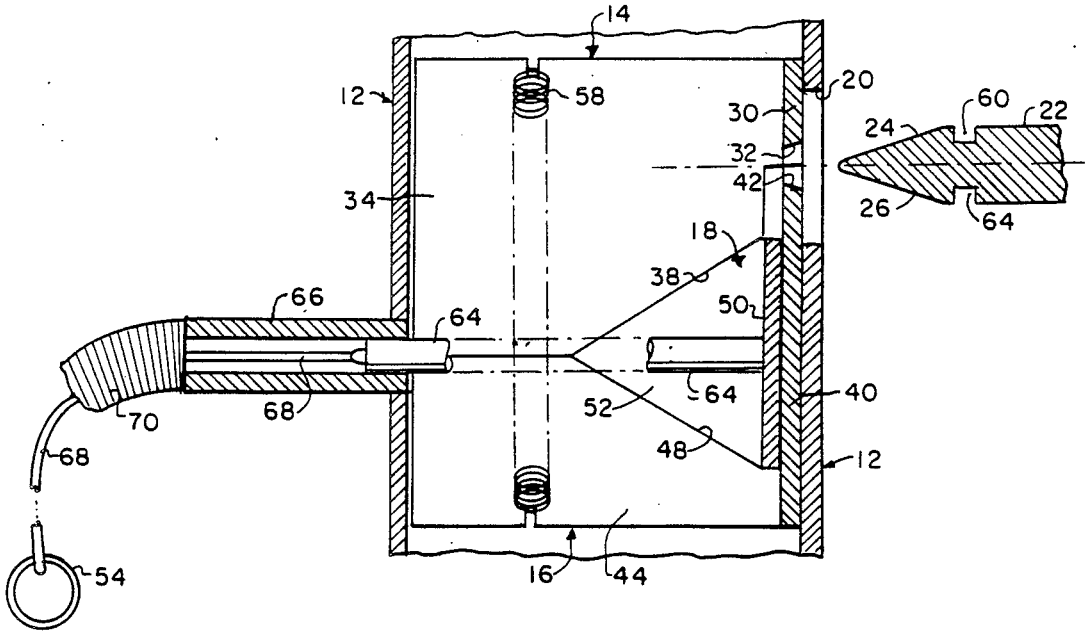
FIG. 2 is a cross-sectional, side elevational view of the window grill latch device of the present invention taken at lines 2—2 of FIG. 1.

Grill latch housing 12 comprises a generally rectangular tubular member having a bolt receiving opening 20 in one side thereof (see FIG. 2) of a large enough size to allow ample clearance for window grill bolt 22 to pass therethrough, taking into account any possible inaccuracies of manufacture.

Upper latch member 14 comprises, essentially, an upper bolt receiving faceplate 30 having a bolt engaging notch 32 therein adapted to engage and retain the top of bolt 22.

Upper latch member 14 also comprises a pair of first and second side panels 34 and 36, respectively, with the bottom corner of each side panel proximate bolt receiving face plate 30 beveled to define generally straight first and second sloping edges 38 and 39, respectively.

Lower latch member 16 comprises, essentially, a lower bolt receiving faceplate 40 having a bolt engaging notch 42 therein adapted to engage and retain the bottom of bolt 22.

Lower latch member 18 also comprises a pair of first and second side panels 44 and 46, respectively, with the top corner of each side panel proximate bolt receiving face plate 40 beveled to define generally straight first and second sloping edges 48 and 49, respectively.

Latch actuating member 18 comprises, essentially, latch actuating face plate 50 adapted to engage or rest against lower bolt receiving face plate 40 of lower latch member 16.

Latch actuating member 18 also comprises a pair of first and second actuator wedges 52 and 54, respectively, attached to each side of latch actuating face plate 50 and slidably engaging the walls of housing 12.

The sloping edges 53 and 55 of wedge 52 are adapted to slidably engage straight sloping edge or bevel 38 of upper latch side panel 34 and sloping edge or bevel 48 of lower latch side panel 44, respectively.

In a like manner, the sloping edges 57 and 59 of wedge 54 are adapted to slidably engage straight sloping side or bevel 39 of upper latch side panel 36 and sloping side or bevel 49 of lower latch side panel 46, respectively.

Latch actuating member 18 further comprises an actuating rod 64 having one end attached to latch actuating face plate 50 and its other end received in actuating rod guide 66.

Attached to the end of actuating rod 64 received in guide tube 66 is actuating cable 68. Actuating cable 68 passes out of the end of guide tube 66 distal actuating rod 64 and is enclosed in cable guide sheath 70 to eventually be connected to operating handle 56 inside the building.

A latch retainer spring 58 having one end connected to upper latch member 14 and its lower end connected to lower latch member 16 is used to bias upper latch member 14 and lower latch member toward each other causing upper latch notch 32 and lower latch notch 42 to be maintained at their closest proximity.

Thus, when grill bolt 22 is pushed through the opening defined by notches 32 and 42, notches 32 and 34 will engage the sloping sides 24 and 26 proximate the point of bolt 22 and be biased against bolt 22 by spring 58. When bolt upper notch 60 reaches bolt receiving notch 32, the bias from spring 58 will cause notch 32 to drop into bolt notch 60. In a like manner, when bolt lower notch 64 reaches bolt receiving notch 42, the bias from spring 58 will cause notch 42 to drop into bolt notch 64.

Figure 6:
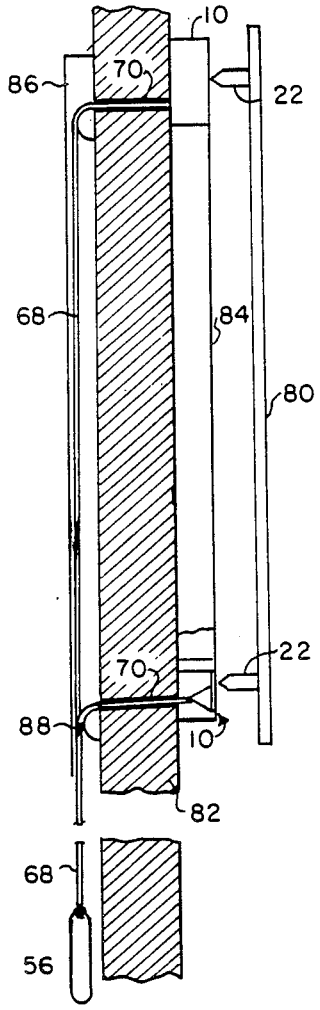
FIG. 6 is a cross-sectional, elevational view of a typical window grill utilizing the window grill latching mechanism of the present invention.

With reference to FIG. 6, there is illustrated a cross-sectional, elevational view of a typical window grill 80 installed on the outside wall 82 of a building with grill latch device 10 of the present invention located proximate the top and bottom of frame 84 attached to wall 82.

Figure 5:
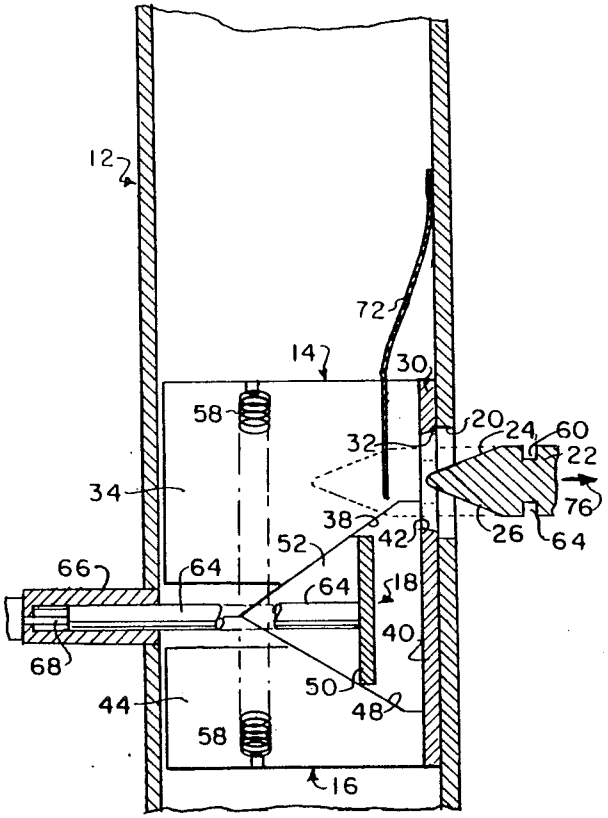
FIG. 5 is a cross-sectional, side elevational view of the window grill latch of the present invention showing the positioning of the various parts of the latch after actuation of the grill latch mechanism when the grill bolt is released and ejected from the latching mechanism.
Figure 4:
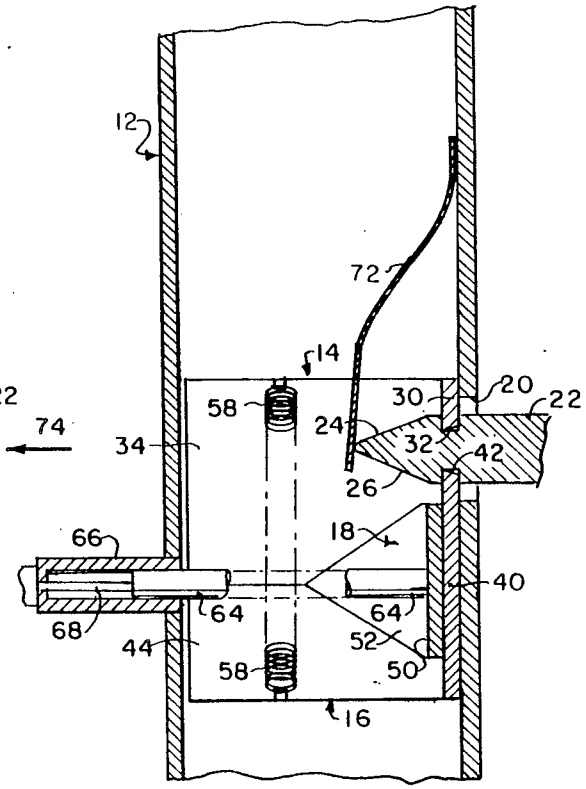
FIG. 4 is a cross-sectional, side elevational view of the window grill latch of the present invention showing the positioning of the various parts of the latch when the grill bolt is fully inserted into the latch.
Figure 3:
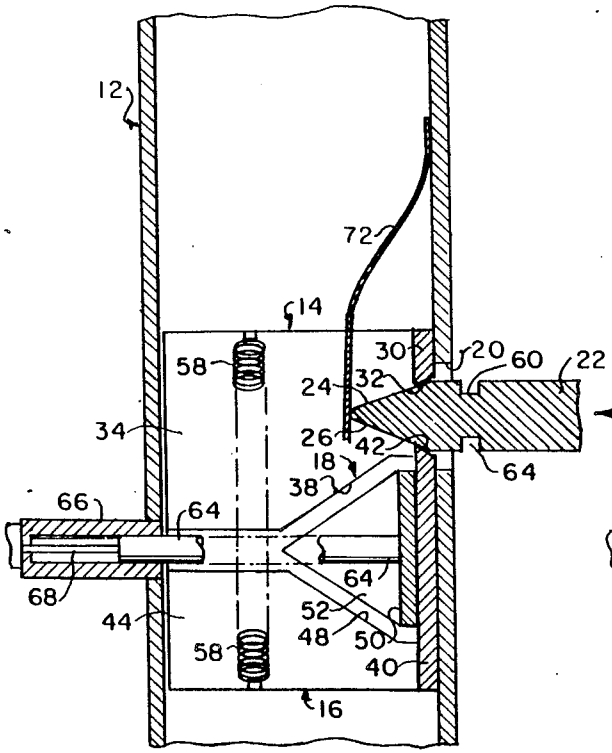
FIG. 3 is a cross-sectional, side elevational view of the window grill latch of the present invention showing the positioning of the various parts of the latch when the grill bolt is partially inserted into the latch as would be the case when the window grill is being closed.

Operating handle 56 attached to actuating cable 68 is located inside the building. Cable 68 is enclosed in a molding 86. The cables from each of the grill latch devices 10 are attached to each other at point 88 to be actuated by common handle 56. Operation:

With reference to FIG. 3, 4 and 5, there is illustrated the operating sequence of grill latch device 10 of the present invention.

FIG. 3 illustrates the position of the various parts of grill latch 10 as grill bolt 22 enters bolt receiving opening 20 and engages upper and lower bolt engaging notches 32 and 42, respectively.

FIG. 4 illustrates the positions of the various parts of grill latch device 10 after grill bolt 22 is latched in place.

FIG. 5 illustrates the positions of the various parts of grill latch device 10 upon actuation of latch actuating member 18 to release grill bolt 22 from grill latch device 10.

It will be noted in FIGS. 3, 4 and 5, that a bolt ejection spring 72 is provided having one end attached to the inside of housing 12. The other end of bolt ejection spring 72 is adapted to engage the point of bolt 22 to provide a constant bias against the point of bolt 22 so that, when released by the operation of latch actuating member 18, it is automatically ejected.

This ejection function could also be accomplished by use of a coil spring connected to grill member 80 and biased against the outside of housing 12.

To operate the grill latch device 10 of the present invention grill bolt 22 is inserted between upper bolt engaging notch 32 in upper latch face plate 30 and lower bolt engaging notch 42 in lower latch face 40 in the direction shown by arrow 74.

Bolt 22 is pushed through the opening to force upper latch member 14 and lower latch member 16 apart as upper notch 32 and lower notch 42 slidably engage the sloping sides 24 and 26, respectively, as shown in FIG. 3.

At this position, upper latch member 14 and lower latch member 16 are pulled apart leaving a space between upper bevel 38 and actuating wedge 52 as well as between lower bevel 48 and actuating wedge 52.

As grill bolt 22 continues through opening 20, the tip of bolt 22 engages the lower end of ejection leaf spring 72.

As grill bolt 22 continues through opening 20, the lip of upper notch 32 and the lip of lower notch 42 will engage upper notch 60 and lower notch 62, respectively, in grill bolt 22 as shown in FIG. 4. Because spring 58 biases upper latch member 14 toward lower latch member 16, the lips of notches 32 and 42 will engage notches 60 and 62 to retain grill bolt 22 between upper and lower bolt receiving notches 32 and 42.

To release grill bolt 22 from upper and lower latch members 14 and 16, respectively, cable 68 is pulled to cause actuating wedge 52 to move to the left, in FIG. 5, slidably bearing against upper bevel 38 and lower bevel 48 thus forcing upper latch member 14 and lower latch member 16 apart, as shown in FIG. 5.

When thus forced apart, bolt engaging notches 32 and 42 are also moved apart releasing notches 60 and 62, whereby leaf spring 72 can now force grill bolt to the right, as indicated by arrow 76.

Figure 7:
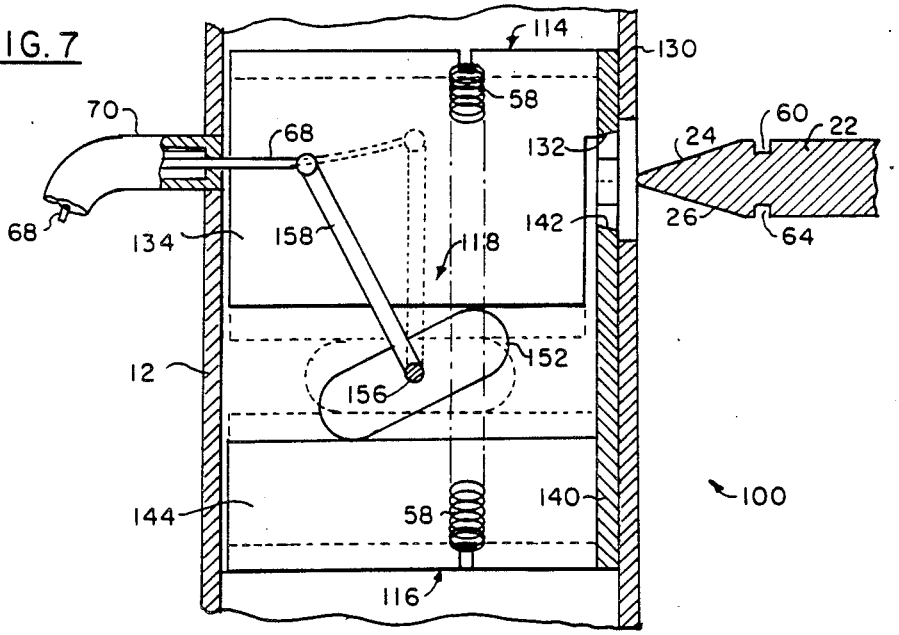
FIG. 7 is a cross-sectional, side elevational view of a further embodiment of the window grill latch mechanism of the present invention utilizing a cam or lever type release latch.

With reference to FIG. 7 there is illustrated a further embodiment of the latching device of the present invention.

Grill latching device 100 of FIG. 7 is similar to grill latching device 10 of FIGS. 1 through 6, with the exception that upper latching member 114 and lower latching member 116 are not beveled as is the case for upper latching member 14 and lower latching member 16 for FIGS. 1 through 6.

In FIG. 7, a cam-like or lever-like actuating member 118 is used which comprises an actuating cam or lever 152 attached to pivot pin 156 which is journalled to holes or bearings on opposite sides of housing 12.

Actuating arm 158 is attached at one end to pivot pin 156 and at is other end to actuating cable 68.

When actuating cable 68 is pulled, actuating arm 158 causes cam or lever 152 to rotate and bear against the bottom edge of upper latch member 114 and the top edge of lower latch member 116. In so doing, latch members 114 and 116 are spread apart similar to the action of actuating wedge 18 in FIGS. 1 through 5.

When the pull on cable 68 is released, the bias from spring 58 will cause upper latch member 114 and lower latch member 116 to move toward each other causing cam or lever 152 to rotate back to its rest position shown by the dashed lines.

Although the present invention has been described in detail, the scope of this invention is not intended to be limited by the above description but only by the claims as indicated below.

What is claimed is:

1. A grill latch comprising means defining a latch guide housing having means defining a bolt receiving opening therein, an upper latch member disposed in said latch guide housing comprising an upper bolt receiving face plate disposed proximate said bolt receiving opening in said latch guide housing, a pair of upper side panels attached to each side of said upper bolt receiving face plate and adapted to slidably engage opposite sides of said latch guide housing, a lower latch member disposed in said latch guide housing comprising a lower bolt receiving face plate disposed proximate said bolt receiving opening in said latch guide housing, a pair of lower side panels attached to each side of said lower bolt receiving face plate and adapted to slidably engage opposite sides of said latch guide housing, means for moving said upper and lower latch members toward and away from each other comprising means, slidably engaging said upper side members proximate the bottom thereof and slidably engaging said lower side members proximate the top thereof, for moving said upper and lower latch members toward and away from each other.

2. The grill latch as claimed in claim 1 wherein said upper latch member further comprises the corner of each side panel along the bottom edge thereof proximate said bolt receiving face plate being beveled to define a sloping edge, and wherein said lower latch member further comprises the corner of each side panel along the top edge thereof proximate said bolt receiving face plate being beveled to define a sloping edge, and said means for moving said upper and lower latch members toward and away from each other comprises an actuating wedge adapted to slidably engage the walls of said housing and said bevels and sloping edges in said upper and lower latch receiving members, and means for moving said actuating wedge laterally toward and away from said upper and lower latch receiving faceplates to slidable engage said bevels and said sloping edges to move said upper and lower latch members away from and toward each other.

3. A grill latch comprising means defining a tubular housing having a generally rectangular cross section, means defining a bolt receiving opening in one side of said housing, a generally U-shaped upper latch member comprising an upper bolt engaging face plate defining the base of the "U" of said upper U-shaped member disposed in said housing and adapted to slidably engage an inside surface of said housing proximate said bolt receiving opening, a pair of upper side panels defining the legs of the "U" of said upper U-shape member attached to each end of said bolt engaging face plate and adapted to slidably engage opposite walls of said housing, an upper bevel in the lower corner of each of said upper side panels proximate said bolt engaging face plate, said bevel defining a generally straight sloping edge, a generally U-shaped lower latch member comprising a lower bolt engaging face plate defining the base of the "U" of said lower U-shaped member disposed in said housing and adapted to slidably engage an inside surface of said housing proximate said bolt receiving opening, a pair of lower side panels defining the legs of the "U" of said U-shape member attached to each end of said bolt engaging face plate and adapted to slidably engage opposite walls of said housing, a lower bevel in the upper corner of each of said lower side panels proximate said bolt engaging face plate, said bevel defining a generally straight sloping edge and located adjacent the bevel in said upper U-shaped member side panels, a latch actuating member comprising a pair of actuating wedges adapted to engage said upper and lower bevels on opposite side of said housing, and means for moving said actuating wedges perpendicular to the wall of said housing having said bolt receiving opening while slidably engaging said upper and lower bevels.

4. In a window grill latch having a means defining a latch guide housing including means defining a bolt receiving opening therein, an upper latch member disposed in said latch guide housing comprising an upper bolt receiving face plate disposed proximate said bolt receiving opening in said latch guide housing, a pair of upper side panels attached to each side of said upper bolt receiving face plate and adapted to slidably engage opposite sides of said latch guide housing, a lower latch member disposed in said latch guide housing comprising a lower bolt receiving face plate disposed proximate said bolt receiving opening in said latch guide housing, a pair of lower side panels attached to each side of said lower bolt receiving face plate and adapted to slidably engage opposite sides of said latch guide housing, the improvement comprising, means for moving said upper and lower side members toward and away from each other comprising the corner of each upper side panel along the bottom edge thereof proximate said bolt receiving face plate being beveled to define a sloping edge, the corner of each lower side panel along the top edge thereof proximate said bolt receiving face plate being beveled to define a sloping edge, an actuating wedge adapted to slidably engage the walls of said housing, said bevels and sloping edges in said upper and lower side panels in said upper and lower latch receiving member, and means for moving said actuating wedge laterally toward and away from said upper and lower latch receiving faceplates to slidably engage said bevels and said sloping edges to move said upper and lower latch members away and toward each other.

5. In a window grill latch having a means defining a latch guide housing including means defining a bolt receiving opening therein, an upper latch member disposed in said latch guide housing comprising an upper bolt receiving face plate disposed proximate said bolt receiving opening in said latch guide housing, a pair of upper side panels attached to each side of said upper bolt receiving face plate and adapted to slidably engage opposite sides of said latch guide housing.

a lower latch member disposed in said latch guide housing comprising a lower bolt receiving face plate disposed proximate said bolt receiving opening in said latch guide housing, a pair of lower side panels attached to each side of said lower bolt receiving face plate and adapted to slidably engage opposite sides of said latch guide housing, the improvement comprising, means for moving said upper and lower side members toward and away from each other comprising a lever arm member pivotally connected to said housing between said upper latch member and said lower latch member and adapted to slidably engage the walls of said housing and the bottom edge of said upper latch member and the top edge of said lower latch member, means for rotating said lever arm member about said pivot for increasing and decreasing the separation between said upper latch member and said lower latch member.

* * * * *